US007866590B2

(12) United States Patent
Naulet et al.

(10) Patent No.: US 7,866,590 B2
(45) Date of Patent: Jan. 11, 2011

(54) WINDING FRAME WITH MONITORED SECONDARY TRAVEL

(75) Inventors: Christophe Naulet, Chambery (FR); Jean-Marc Bouvier, Barberaz (FR)

(73) Assignee: Saint-Gobain Technical Fabrics Europe, Chambery (FR)

( * ) Notice: Subject to any disclaimer, the term of this patent is extended or adjusted under 35 U.S.C. 154(b) by 135 days.

(21) Appl. No.: 11/993,386

(22) PCT Filed: Jun. 20, 2006

(86) PCT No.: PCT/FR2006/050611

§ 371 (c)(1),
(2), (4) Date: May 13, 2008

(87) PCT Pub. No.: WO2006/136751

PCT Pub. Date: Dec. 28, 2006

(65) Prior Publication Data

US 2010/0096488 A1 Apr. 22, 2010

(30) Foreign Application Priority Data

Jun. 24, 2005 (FR) ..... 05 51750

(51) Int. Cl.
*B65H 54/28* (2006.01)
*B65H 54/38* (2006.01)

(52) U.S. Cl. ..... 242/477.3; 242/479.3

(58) Field of Classification Search ..... 242/476.8, 242/479.2, 479.3, 479.5, 479.6, 479.7, 479.8, 242/479.9, 480, 480.1, 480.2, 480.3, 920, 242/477.3, 479.4

See application file for complete search history.

(56) References Cited

U.S. PATENT DOCUMENTS

| | | | | | |
|---|---|---|---|---|---|
| 2,391,870 | A | * | 1/1946 | Beach | 242/476.8 |
| 3,041,664 | A | * | 7/1962 | Green | 65/500 |
| 3,256,079 | A | * | 6/1966 | Cochran | 65/479 |
| 3,292,872 | A | * | 12/1966 | Hayden | 242/476.8 |
| 3,317,148 | A | * | 5/1967 | Martin et al. | 242/476.8 |
| 3,497,148 | A | * | 2/1970 | Heumann | 242/472.8 |
| 3,697,008 | A | * | 10/1972 | Smith | 242/476.8 |
| 3,861,608 | A | * | 1/1975 | Mohr et al. | 242/472.8 |
| 3,946,957 | A | * | 3/1976 | Van Gunten et al. | 242/472.8 |
| 4,046,330 | A | * | 9/1977 | Mueller | 242/476.8 |
| 4,065,065 | A | | 12/1977 | Kallenborn et al. | |
| 4,206,884 | A | * | 6/1980 | Myers | 242/476.8 |
| 5,156,347 | A | | 10/1992 | Gay, II et al. | |
| 2006/0214046 | A1 | * | 9/2006 | Naulet et al. | 242/472.8 |

FOREIGN PATENT DOCUMENTS

| | | |
|---|---|---|
| FR | 1 246 431 | 11/1960 |
| FR | 2 850 093 | 7/2004 |

* cited by examiner

*Primary Examiner*—William E Dondero
(74) *Attorney, Agent, or Firm*—Oblon, Spivak, McClelland, Maier & Neustadt, L.L.P.

(57) ABSTRACT

A winder including a frame including at least one spindle configured to support at least one cake, the spindle able to rotate about a first axis approximately perpendicular to the diameter of the cake, and at least one crosswinding device configured to deposit at least one strand on the spindle with a first traversing movement. The strand is further deposited on the spindle by a follower with a second traversing movement. The follower includes a control device for controlling the second traversing movement.

10 Claims, 5 Drawing Sheets

WINDING FRAME WITH MONITORED SECONDARY TRAVEL

The present invention relates to a device for attenuating and winding thermoplastic strands, especially glass strands.

It will be recalled that the manufacture of reinforcing glass strands results from a complex industrial process, which consists in obtaining strands from streams of molten glass flowing out through the orifices of bushings. These streams are attenuated in the form of continuous filaments, these filaments are then gathered into a roving and are then collected in the form of wound packages.

For the purposes of the invention, the packages are in the form of bobbins, or even more precisely in the form of "cakes", these cakes being intended more particularly for applications involving reinforcement.

The cake is formed using winders which, as their name indicates, are responsible for winding the glass strands, which have been presized, at very high speed (about 10 to 50 meters per second).

These winders attenuate and wind the filaments and the operating parameters of the winders determine, together with those of the bushing, the dimensional characteristics of the strand, especially the linear density expressed in tex (tex being the weight in grams of 1000 meters of fibers or strands).

Thus, to guarantee a constant linear density of the strand throughout the phase of producing the cake despite the increase in its diameter, the speed of the winding member of the winder is servocontrolled so as to ensure a constant linear winding speed of the strand although its angular velocity varies, this speed servocontrol being achieved by reducing the speed of rotation of the spindle that supports the cake as its diameter increases.

Another important parameter that determines the formation of a cake of optimum quality is its ability to be easily unwound, with no loops or parasitic knots being present, and with limited friction. This unwindability is determined by the nature of the construction law (which determines the magnitude of the cake) that has been generated by the winder during the formation of the cake. This construction law incorporates many parameters, one of the most important of which consists of the crossover ratio, often called CR, and the linear density of the strand.

To impose a given crossover ratio on a cake, the winders of the prior art, which essentially consist of a frame generally positioned beneath a bushing, this frame supporting the crosswinding device and at least one rotatable spindle, this spindle being designed, on the one hand, to generate the cake and, on the other hand, to support the latter, give the strand a kinematic or a particular travel from the combination of two movements, namely a first movement which impresses a primary travel on this strand and a second movement which impresses a secondary travel on the strand. The first and second movements are generally applied by a single member providing a combined movement, which member is more generally known as a crosswinding device which is conventionally a helical unit or any other equivalent device, such as a helically grooved wheel, which can describe all or part of the length of the cake.

The crosswinding device therefore ensures axial distribution of the strands along several cakes by the combination of two traversing movements parallel to the axis of the spindle, this subassembly consisting in general of mainly:

a motorized rotary axis on which the actual crosswinding device is mounted, which gives the roving the first traversing movement, called primary movement or C1, by a peripheral contact between the crosswinding device and the strands, so as to make the strands slip from one side of the latter to the other in a rapid movement; and a movable element which supports the assembly and follows the slow second traversing movement of the roving, called the secondary movement or C2.

According to this embodiment, the rovings of strands can move with the crosswinding device, and the spindle supporting the cake is stationary translationally but able to move rotationally.

As a variant of the above system, the secondary travel C2 is obtained by an axial translation of the spindle supporting the cake. According to this second embodiment, the rovings of strands and the crosswinding device are unable to move along the horizontal translation axis (but are able to rotate) and the spindle supporting the cake is able to move translationally and rotationally.

These two winding principles have the particular feature of generating generally cylindrical bobbins having tapered ends, called "cakes", the length of which depends on the primary and secondary travels imposed on the roving, these cakes being intended to be used in the conversion process, by being unwound from the outside (the reverse sense to the winding operation) in order to be subsequently rewound or worked in another form.

However, it may prove problematic to unwind such a cake. This is because it is difficult to manage to control the unwinding of a bobbin and its integrity as such, because several parameters, such as the size that coats the fiber or else the fiberizing tension of the latter, then come into play. Even if their influence is large, these parameters are both often imposed by the process or the final use of the product, and it is very difficult to modify them.

A first solution for taking these unwinding problems into account consist in modifying the crossover ratio and the ratio of the winding speed and the strand deflection speed of the primary movement.

By modifying the value of this parameter, it is possible to modify the angle at which the strands are wound onto the bobbin, which has the effect of acting directly on the arrangement of the turns. Thus, this parameter may be modulated so as to obtain the best compromise between quality of bobbin integrity, needed during the various handling operations of the manufacturing process, and quality of unwinding of the strand, which is of paramount importance for its use during the various strand conversion processes.

However, since the trend is towards products being obtained with ever larger bobbins, with new types of sizes and ever increasing winding speeds, only adjusting the crossover ratio makes it difficult to optimize, with the best compromise, the quality criteria, which are the integrity of the bobbin and its unwindability.

In addition, owing to this new constraint (formation of ever larger bobbins), the problem then arises of drying the latter. This is because drying the cakes after winding is an important and tricky element in the process as it is sought to remove the maximum amount of moisture in the minimum amount of time, and to do so without degrading the product. It is therefore necessary to allow the water trapped in the core of the package to be evacuated easily, by arranging the turns so as to create evacuation channels that allow the best aeration of the package.

This particular arrangement of the turns forming this "porosity" of the cake is obtained with a limited number of crossover ratios, thereby limiting, at the same time, the options of optimizing this ratio in order to obtain good integrity of the cake.

Even more generally, it is not sufficient to produce increasingly large cakes that can be dried and unwound optimally, rather these cakes should in addition be optimally filled. To improve the profitability of each package, it is desirable to increase their filling for an equivalent overall size (length and internal and external diameters), while still guaranteeing their good integrity. The sole means would consist in having a bobbin with ends oriented approximately perpendicular to the axis of the bobbin. Now, to obtain such a result, this would imply a very short primary travel, which is not compatible with the integrity of the package.

The object of the present invention is therefore to solve the abovementioned problems by proposing improvements to the crosswinding device.

For this purpose, the winder according to the invention, essentially consisting of a frame, this frame having at least one spindle designed to support at least one cake, said spindle being able to rotate about a first axis approximately perpendicular to the diameter of the cake, and at least one crosswinding device designed to deposit at least one strand on the spindle with a first traversing movement, the strand being furthermore deposited on the spindle by a follower with a second traversing movement, is characterized in that the follower includes a control device for controlling the second traversing movement.

Thanks to this control device, an adjustment parameter is introduced that allows the kinematics of the second traversing movement of the crosswinding device to be controlled while the cake is being wound.

In preferred embodiments of the invention, one or other of the following arrangements may optionally furthermore be employed:

- the follower cooperates with the crosswinding device;
- the follower cooperates with the spindle;
- the control device comprises a servomotor for at least continuously controlling at least one of the kinematic quantities of the second traversing movement;
- the kinematic quantities are chosen from the speed and the position;
- the crosswinding device comprises at least one helical unit mounted so as to be able to rotate about a second axis approximately parallel to the first axis;
- the crosswinding device comprises at least one wheel provided with at least one groove, this groove being designed to position and guide at least one strand, said wheel being able to rotate about a second axis approximately parallel to the first axis;
- the spindle is fixed to a barrel, said barrel being mounted so as to be able to rotate with respect to the frame about a third rotation axis approximately parallel to said first and second axes;
- the barrel has at least two spindles positioned approximately in positions uniformly distributed along the third rotation axis;
- the spindle is rotated by means of a kinematic chain which includes a motor integrated into said spindle;
- the spindle and its drive motor are fastened to a linear actuator, said actuator being designed to provide the traversing movement of said spindle;
- the helical unit/units and its/their drive motor(s) are fastened to a linear actuator, said actuator being designed to provide the traversing movement of said helical unit/units; and
- the spindle and its drive motor are fastened to a linear actuator, said actuator being designed to provide the traversing movement of said spindle.

Other features and advantages of the invention will become apparent over the course of the following description of one of its embodiments, given by way of nonlimiting example, with reference to the appended drawings.

IN THE DRAWINGS

Figures 4A, 4B:
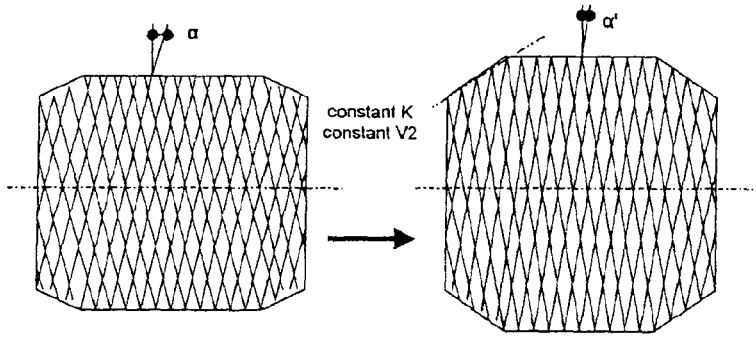
Figure 4a Background Art
Figure 4b Background Art
Figure 5A:
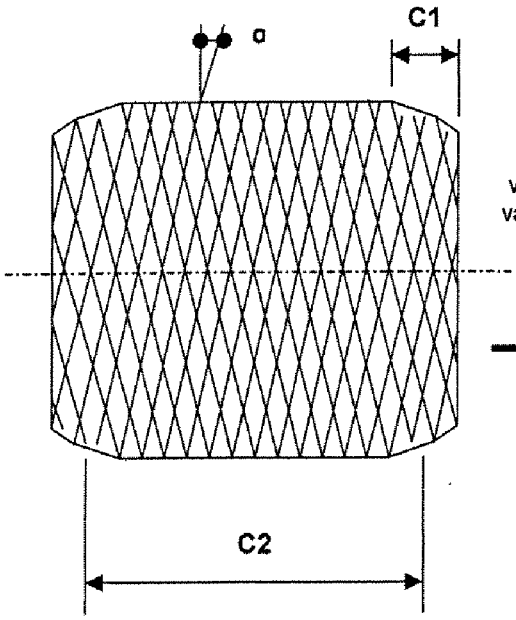
Figure 5B:
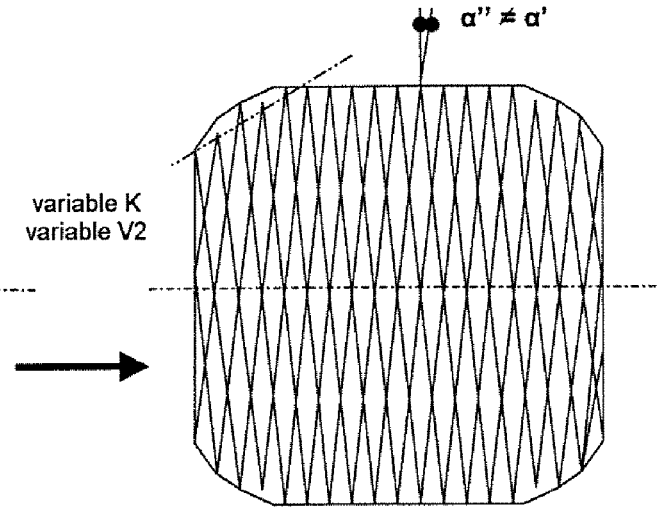

FIGS. 4*a* and 4*b* illustrate profiles of cakes obtained by a winder according to the background art; and FIGS. 5*a* and 5*b* illustrate profiles of cakes obtained by a winder according to the invention.

Figure 6:
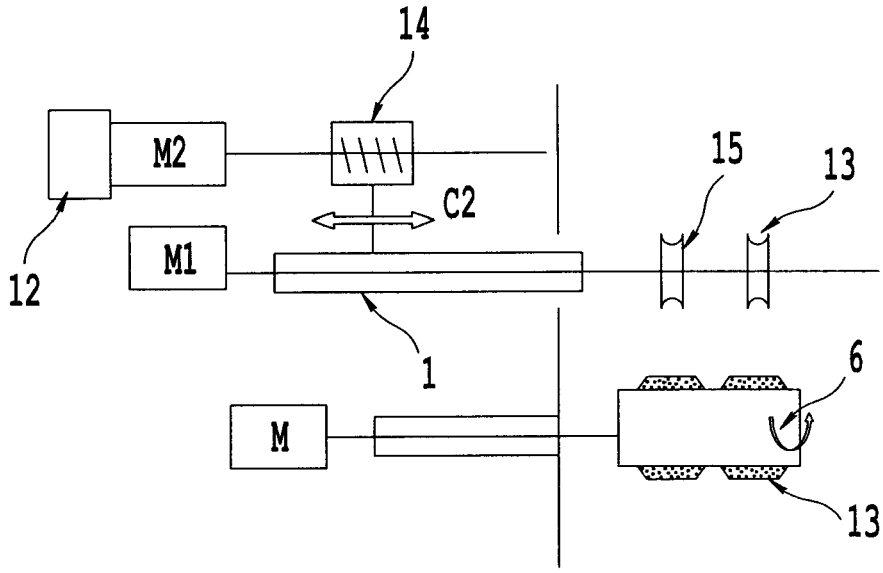

FIG. 6 illustrates a wheel and groove of the crosswinding device according to the invention.

Figure 1:
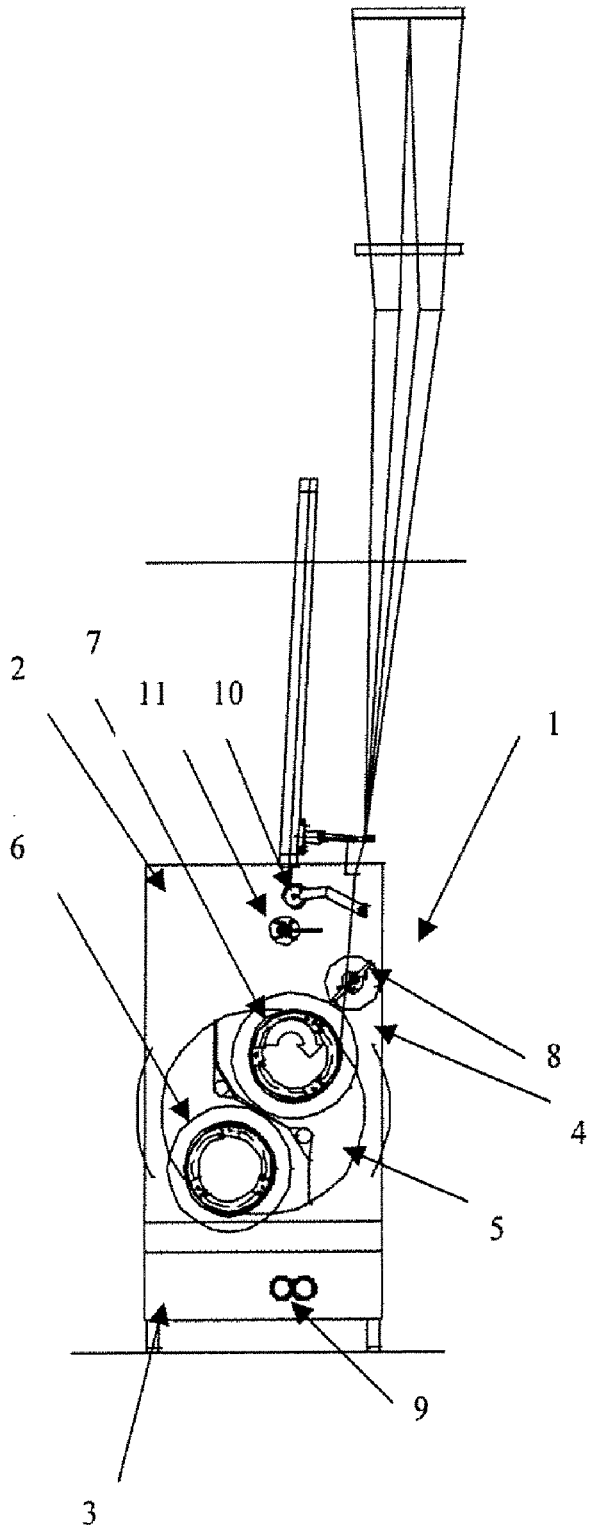
FIG. 1 is a front view of a winder according to the invention.

According to a preferred embodiment of a winder 1 according to the invention illustrated in FIG. 1, this comprises a metal frame 2 obtained by the technique of welding metal components, which are either machined beforehand or commercially available standard components. This frame 2 essentially comprises an approximately rectangular base 3 resting on judiciously placed feet so as to correspond to the configuration or spacing of the forks of a fork-lift truck or of a similar handling device so as to make it easier to install this winder in a fiberizing position.

Assembled on this base is a partly shrouded closed structure 4 intended to receive all the components needed to operate the winder 1. In this regard, but not limitingly, this closed structure in the form of a cabinet is provided with the necessary control and drive devices for the various regulations of the different members that will be described later in the present description, and the supplies—hydraulic, electrical, compressed-air and other fluids—needed to operate said members.

A laterally projecting barrel 5 cooperates on the closed structure 4. This barrel 5 is mounted so as to be able to rotate about a rotation axis (called the third rotation axis) and is held in place within one of the walls of the closed structure by means of a plurality of guiding members (ball-bearing ring, ball-bearing slide, for example). Provision may also be made for this barrel 5 to be motorized so that it can describe and index a plurality of angular positions with respect to the frame 2 while the cakes are being wound.

This barrel 5 constitutes a spindle support assembly. FIG. 1 shows that the barrel 5 has two spindles 6, 7, in diametrically opposed positions (it is conceivable to have a barrel with only a single spindle [if there is only one spindle, there is no need for a barrel, but it is not possible for the spindle to be automatically restarted] or, on the contrary, a barrel having at least three, four or even more spindles, depending on the available space and the capacity of the bushing positioned upstream). Within the winder, the barrel 5 hangs up a spindle unloaded beforehand and provided with a fresh forming tube (for the purpose of the invention, a forming tube is a plastic or cardboard support intended to receive the strand package or cake) in the winding position and another spindle having its full winding tubes in the unloading position by rotations through 180° (if the barrel has two spindles, as appears in the examples).

By motorizing the barrel 5 and by regulating its angular position and/or its angular velocity, for example by controlling the number of revolutions of the gearmotor responsible for driving the barrel, said gearmotor engaging for example with the barrel 5 at its driveshaft via a gear-type link, it becomes possible to position the active spindle approximately in line with the strand and the spindle moves back or away from its original angular position as the cake enlarges, so as to maintain a fixed geometry.

Each of the spindles 6, 7 fastened to the barrel 5 constitutes a rotating assembly suitable for winding the strand onto a forming tube introduced beforehand onto the shaft or spindle nose. This winding is performed with respect to a first rotation axis approximately parallel to the rotation axis of the barrel 5 relative to the structure of the frame 2. Apart from a rotational movement caused by a rotor motor built into the spindle about this first axis, the spindle may be suitable for performing a traversing travel parallel to the first rotation axis (secondary travel movement C2)—in the contrary case, it is the crosswinding system that will do it in the same way (secondary travel movement C2). This traversing movement is produced by a motorized actuator with a linear movement (ballscrew for example) fastened, on the one hand, to the barrel or the frame and, on the other hand, to the body of the spindle.

The figure shows another element essential for producing a cake. This is the device 8 for crosswinding the strand onto the spindle 6 or 7, in this example a helical unit. This helical unit is rotated by a drive member about a shaft coaxial with a second axis approximately parallel to those mentioned above. The rotation speed of the member for driving the helical unit is regulated according to the cake construction law and provision is made for these control and command devices to be integrated into the frame-forming structure 2.

Of course, if it is desired to produce several cakes simultaneously on the same spindle 6 or 7, the number of helical units 8 will be adapted accordingly, and the helical unit support shaft will include a train of helical units, the number of which will be equal to the number of cakes desired.

The rotational movement of the helical unit gives the strand an oscillatory movement, the amplitude and frequency of which are adjustable according to the desired crossover ratio values. The frequency is determined according to the rotation speed, and the amplitude is determined according to the geometry of the helical unit.

Other devices (not shown in FIG. 1) may be envisaged as a substitute for the helical unit. As shown in FIG. 6, this may be a wheel 15 provided with at least one groove 13, this groove 13 being designed to position and guide at least one strand, said wheel 15 being able to rotate about a second axis approximately parallel to the first axis.

Figure 3:
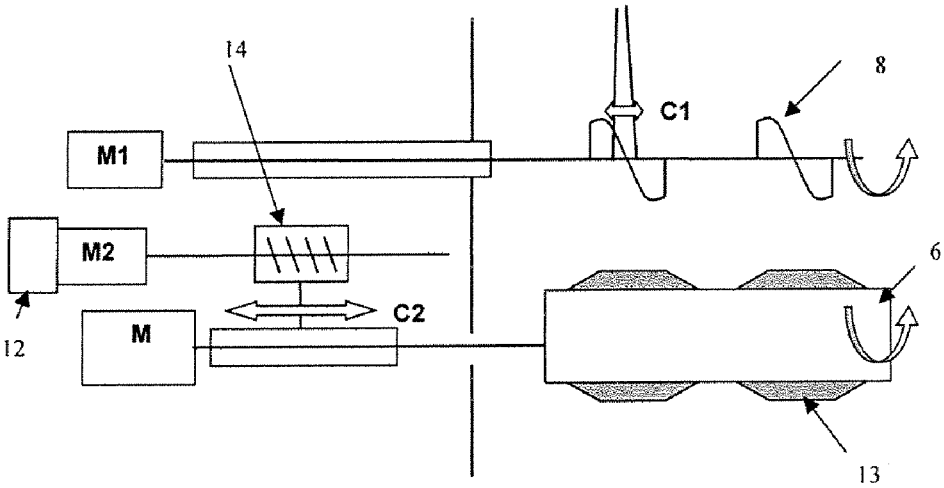
FIG. 3 is a side view of the winder illustrating the traversing movements of the primary and secondary travels according to an alternative embodiment.

Whatever the embodiment of the crosswinding device 8, this performs what is called a primary travel movement or C1 and operates with speed and possibly position regulation with the to-and-fro movement of the spindle 6 or 7 that constitutes what is called the secondary travel movement C2, according to the alternative embodiment illustrated in FIG. 3, the movement of the spindle 6 or 7 in a traversing movement along a direction parallel to its rotation axis being performed by an actuator M2 engaged by means of a kinematic chain with the spindle support shaft.

Figure 2:
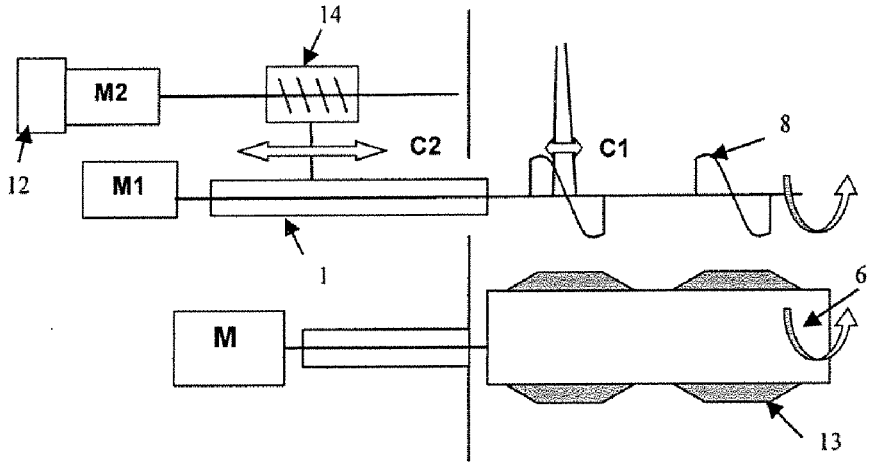
FIG. 2 is a side view of the winder illustrating the traversing movements of the primary and secondary travels; according to the invention.

According to another alternative embodiment illustrated in FIG. 2, the crosswinding device 8 is mounted on a shaft driven in rotation by a motor M1, which ensures the first traversing movement of the roving, called the primary movement or C1. This assembly cooperates by means of a kinematic chain 14 of the nut/screw type or the like, kept in motion by means of an actuator M2 (for example a motor) for impressing on this assembly a translational movement along an axis approximately parallel to the rotation axis of the crosswinding device so as to give the latter an additional traversing movement, called the secondary movement or C2.

Whatever the embodiment illustrated in FIG. 2 or in FIG. 3, it should be noted that the actuator M2 is provided with an additional control member 12 of the position- and/or speed-controlled servomotor type for continuously controlling the displacement kinematics (speed and/or position) of the actuator responsible for imparting the secondary traversing movement C2.

According to one advantage of the invention, the primary and secondary movements of the winder 1 are decoupled by means of the control member 12. This additional control member 12 offers the options of regulating and of optimizing the arrangement of the turns, which may solve the problems of cake integrity for a given crossover ratio meeting an unwinding requirement and a drying requirement. The variations of this control member may also make it possible to increase the quantity of strands deposited at the ends of the cake so as to favor their filling.

Other subassemblies necessary for the operation of the winder 1 are integrated into the frame 2. Thus, a strand-pull 9 is positioned near the base 3 of the frame 2. A strand-pull 9 is a strand drive assembly used during the restart, the restart being a transient phase prior to a winding phase. For this purpose, the strand is pulled by a train of motorized wheels, with smooth or embossed walls (the strands are introduced under operating conditions compatible with engagement of the strands in the spindle nose during the start of the winding phase).

The winder includes at least one rotary ejector 10 and at least one straight ejector 11, these projecting laterally with respect to the closed structure 2, and vertically above the barrel 5.

The rotary ejector 10, or retracting device, is formed by an arm articulated at one of its ends to the closed structure of the frame 2, its free end being designed to grasp and move the strands between a first position, in which the strands are engaged with the strand crosswinding device 8 (for example the helical unit), and a second position, in which the strands are retracted with respect to said crosswinding device 8. The angular movement of the rotary ejector 10 is performed when changing over a spindle 6 or 7 (180° pivoting of the barrel 5).

The straight ejector 11, as its name indicates, is a substantially straight arm. Projecting laterally, like the rotary ejector 10, with respect to a side wall of the closed structure of the frame 2, it may occupy two positions, namely a rest position in which it is set back from the path of the strand and a working position in which it keeps the strand above the nose of the spindle 6 or 7 during restart. This working position is also occupied during a transfer operation (rotation of the barrel and transition from a spindle with wound cakes to a spindle with empty tube holders).

Positioned near the strand crosswinding device 8 (for example a helical unit) is a cleaning member (not visible in the figures) for cleaning said positioning device by spraying it with a pressurized fluid.

As the winding proceeds (increase in thickness of the strands on the cake), the barrel 5 performs an angular correction by rotation and indexation of its angular position about its axis so as to move the "active" spindle—that on which the winding by the device takes place—is moved further away from the periphery of the strand positioning and guiding device so as to maintain a fixed geometry.

The winding is active winding, the primary travel and secondary travel movements being controlled by the control device 12 so as to conform to the construction law.

As may be seen in FIGS. 4*a* and 4*b*, the cake obtained by winding a roving of strands using a winder of the prior art varies over the course of its construction in the following manner: the angle α, which is the wind angle (the angle developed such that $\tan \alpha = V_{cross}/V_{strand}$) passes to a lower value α'. During this winding, the speed of the secondary movement remains constant at a value V2, as does the crossover ratio K (the crossover ratio K being defined as the ratio of the speed of the spindle to the speed of the crosswinding device $V_{cross}$).

It will be recalled that, in order to keep a constant linear density thereof during winding, it is necessary to keep a constant drawing speed ($V_{strand}$). Therefore the speed of the spindle necessarily decreases (owing to the increase in diameter) and, since K is constant, the speed of the crosswinding device $V_{cross}$ must decrease in the same proportions. As $V_{cross}$ decreases and that $V_{strand}$ necessarily α is smaller and is equal to α'.

Now let us study the winding of a cake using a winder according to the invention, that is to say one provided with the device 12 for controlling the secondary movement C2, in which it is therefore possible for both K and V2 to be variable.

As may be seen in FIGS. 5*a* and 5*b*, which show the variation in the construction of the cake during winding, the angles α' and α" are different; in the example, α is closer to α' than α", and it is possible to accumulate or wind the strand on the ends of the cake (above the dot-dash line—compare FIG. 4*b* with FIG. 5*b*). To be able to vary the speed and/or the position of the secondary travel C2 during the winding, the control device is controlled by a programmable controller and "ad hoc" software that determines at any moment the actions on the servomotor acting on the travel C2.

The invention claimed is:

1. A winder comprising:

a frame including at least one spindle, the at least one spindle supporting at least one cake and rotating about a first axis perpendicular to a diameter of the at least one cake;

at least one crosswinding device to deposit at least one strand on the spindle with a first traversing movement, the at least one strand being further deposited on the spindle by an actuator with a second traversing movement;

wherein the actuator includes a control device to control the second traversing movement, the control device including a servomotor to at least continuously control at least one kinematic parameter of the second traversing movement and being configured to determine at all times the actions of the servomotor acting on the second traversing movement and make the crossover ratio of a speed of the spindle to a speed of the crosswinding device ($V_{cross}$) and a speed of the secondary traversing movement variable, thereby obtaining a first developed wind angle following an increase in a diameter of the at least one cake different from a second developed wind angle obtained when the crossover ratio and speed of the secondary traversing movement are constant, the first and second developed wind angle being determined from an equation $$\tan \propto = V_{cross}/V_{strand},$$

wherein ∝ represents a developed wind angle and $V_{strand}$ represents a constant drawing speed.

2. The winder as claimed in claim 1, wherein the actuator cooperates with the crosswinding device.

3. The winder as claimed in claim 1, wherein the actuator cooperates with the spindle.

4. The winder as claimed in claim 1, wherein the crosswinding device includes at least one helical unit mounted to rotate about a second axis approximately parallel to the first axis.

5. The winder as claimed in claim 4, wherein the at least one helical unit and corresponding drive motor rotating the helical unit are fastened to the actuator including a linear actuator, the linear actuator providing the second traversing movement of the at least one helical unit.

6. The winder as claimed in claim 1, wherein the crosswinding device includes at least one wheel having at least one groove, the groove positioning and guiding at least one strand, the wheel rotating about a second axis parallel to the first axis.

7. The winder as claimed in claim 1, wherein the spindle is fixed to a barrel, the barrel being mounted to rotate with respect to the frame about a third rotation axis parallel to the first axis and second axis.

8. The winder as claimed in claim 7, wherein the barrel includes at least two spindles uniformly distributed along the third rotation axis.

9. The winder as claimed in claim 1, wherein the spindle is rotated by a kinematic chain, the kinematic chain having a motor integrated into the spindle.

10. The winder as claimed in claim 1, wherein the spindle and corresponding drive motor rotating the spindle are fastened to the actuator including a linear actuator, the linear actuator providing the second traversing movement of the spindle.

* * * * *